US007654343B2

(12) United States Patent
Snow

(10) Patent No.: US 7,654,343 B2
(45) Date of Patent: Feb. 2, 2010

(54) DEVIATED DRILLING METHOD FOR WATER PRODUCTION

(76) Inventor: David T. Snow, 9813 W. 83rd Ave., Arvada, CO (US) 80005

( * ) Notice: Subject to any disclaimer, the term of this patent is extended or adjusted under 35 U.S.C. 154(b) by 38 days.

(21) Appl. No.: 11/686,809

(22) Filed: Mar. 15, 2007

(65) Prior Publication Data

US 2008/0223617 A1 Sep. 18, 2008

(51) Int. Cl.
*E21B 7/04* (2006.01)

(52) U.S. Cl. ..... 175/61; 175/62

(58) Field of Classification Search ..... 175/61, 175/62, 57; 166/50, 51, 255.3, 117.5
See application file for complete search history.

(56) References Cited

U.S. PATENT DOCUMENTS

| | | | | |
|---|---|---|---|---|
| 1,480,674 | A * | 1/1924 | Diescher | 166/286 |
| 4,852,669 | A * | 8/1989 | Walker | 175/73 |
| 5,163,521 | A | 11/1992 | Pustanyk et al. | |
| 5,213,168 | A | 5/1993 | Warren et al. | |
| 5,289,888 | A * | 3/1994 | Talley | 175/61 |
| 5,343,965 | A | 9/1994 | Talley et al. | |
| 5,368,109 | A | 11/1994 | Pittard, Jr. et al. | |
| 5,396,950 | A | 3/1995 | Talley et al. | |
| 5,771,976 | A | 6/1998 | Talley | |
| 5,785,133 | A | 7/1998 | Murray et al. | |
| 6,035,953 | A | 3/2000 | Rear | |
| 6,422,318 | B1 | 7/2002 | Rider | |
| 6,988,548 | B2 | 1/2006 | Diamond et al. | |
| 2003/0131989 | A1 | 7/2003 | Zakiewics | |
| 2004/0104051 | A1 * | 6/2004 | Moriarty et al. | 175/57 |

OTHER PUBLICATIONS

Weight, Willis D.; Sonderegger, John L. Manual of Applied Field Hydrogeology. (pp. 111). McGraw-Hill. Online version available at: http://knovel.com/web/portal/browse/display?_EXT_KNOVEL_DISPLAY_bookid=1314&VerticalID=0.*

Mailfaganam, et al., Groundwater exploitation of a shallow coastal sand aquifer in Sarawak, Malaysia, Hydrology of Warm Humid Regions (Proceedings of the Yokohama Symposium, Jul. 1993), IHAS Publ. No. 216, 1993, pp. 451-461.

Jay Lehr et al., Design and Construction of Water Wells: A Guide for Engineers, Van Nostrand Reinhold Company, New York, 1988, p. 216.

* cited by examiner

*Primary Examiner*—David J Bagnell
*Assistant Examiner*—James G Sayre
(74) *Attorney, Agent, or Firm*—Marian J. Furst

(57) ABSTRACT

Method for drilling horizontal or deviated fresh water wells through such volcanics as occur in Hawaii, including hard lavas and fragmented interbeds that are prone to caving. The method provides effective means to drill into basal aquifers directly underlain by salt water, or into compartmented or confined aquifers or perched aquifers. The method uses deviated drilling and may use formation grouting, casing or drill-stem drilling, percussion or rotary drilling and all combinations thereof.

19 Claims, 6 Drawing Sheets

DEVIATED DRILLING METHOD FOR WATER PRODUCTION

CROSS REFERENCE TO RELATED APPLICATIONS

This application claims the benefit of the filing date of U.S. Provisional Application Ser. No. 60/566,551, filed on Apr. 29, 2004, entitled "An Application of Deviated Drilling by the Casing Drilling Method or Other Methods for the Construction of Horizontal Wells to Produce Groundwater from the Freshwater Lens of the Hawaiian Basal Aquifers, Dike-Compartmented Aquifers and Perched Aquifers," and of U.S. patent application Ser. No. 11/116,715, filed on Apr. 28, 2005, entitled, "Deviated Drilling Method for Water Production," both of which are incorporated herein by reference in their entirety.

FIELD OF THE INVENTION

The present invention relates generally to a method for drilling horizontal or deviated water wells through volcanic hard rock formations and fragmented formations that are prone to caving and to a well drilled in such formations. More specifically, the present invention relates to a method for drilling wells deviated from generally near-vertical at the surface to a substantially horizontal orientation below the water table. It is particularly suited for drilling deviated wells in Hawaiian volcanics.

BACKGROUND OF THE INVENTION

At shallow depths, pore spaces in rocks and soil are filled with air or a combination of air and water. The water table is the level at which groundwater saturates the pore spaces of coarse rock and soils, extending to a depth where the rock porosity vanishes or the rock is molten. In coarse-grained rocks, voids in the unsaturated zone are at atmospheric pressure down to the water table, and meteoric water that percolates downward through the unsaturated zone recharges the groundwater by flowing across the water table. In such mountainous areas as the Hawaiian Islands, most of the groundwater flow collects in upgradient areas of great precipitation, so the water table of the basal aquifer near the coast is nearly a flow line, inclined at a very small angle, about 0.05 degrees to the horizon. In areas central to most Hawaiian volcanoes, groundwater flow is impeded by near-vertical basalt dikes that compartment the aquifer and cause high-level water table conditions. In some localized situations, "perched" groundwater is underlain by a layer of low-permeability rock, below which the soil or rock is unsaturated with water.

FIG. 1 illustrates a common water table condition elsewhere in the world, of modest semi-homogeneous hydraulic conductivity. In such venues, well 100 is typically drilled vertically from a position on the ground that is somewhat higher than streambed 102. Water table 104, marking the boundary between unsaturated zone 106 and water-saturated zone 108, rises gradually underneath the valley walls as the distance from streambed 102 increases. Pump 110 is positioned within well 100 at a depth that is initially below water table 104. As water is pumped to the surface through well 100, drawdown occurs and a portion of the subsurface rock and soils adjacent to well 100 becomes unsaturated with water. A local lowering or downward "coning" of the water table occurs, as indicated at 112.

Typically, the economical and practical method of groundwater production from water table aquifers is by pumping the water from vertical or nearly vertical wells drilled to depths that penetrate below the water table, as shown in the sketch section of FIG. 1. Lowering the water level in a well causes the groundwater to flow through the pores in the rock and into the well to replenish it continuously.

To produce hydrocarbons, the petroleum industry has in recent times increasingly used wells that are deviated or curved from vertical at the surface to sub-horizontal at depth, rather than wells that are vertical throughout their length. Usually, these wells originate at the surface as vertical or near-vertical wells, and at some point below the surface, the drilling trajectory curves to a shallower angle or even a horizontal attitude trajectory. Although a deviated horizontal well is more expensive to drill than a straight vertical well in some circumstances, the potential hydrocarbon recovery from a horizontal or sub-horizontal well is significantly greater than from a vertical well, and fewer wells need to be drilled. In recent years, methods and equipment have been developed to control the drilling trajectory so the deviated or sub-horizontal portion of the well traverses the desired section of rock. In particular, steerable drill bits have been developed, with the ability to control the angle from vertical as well as the compass direction in which the drilling progresses. For some applications, particularly offshore petroleum drilling, a single vertical shaft is drilled from the surface, and multiple deviated well bores are drilled outwards from the vertical shaft, using a technique called "whipstocking." Such radial arrangements of deviated bores originating from a single vertical section have been used to penetrate specific subsurface targets, such as oil-bearing sands and remote or offshore geologic structures.

FIG. 2 illustrates two circumstances in which deviated drilling has been used for hydrocarbon production. A vertical well section 200 is drilled downwards from the ground surface 202. Deviated well bore 204 branches off of vertical section 200 to intersect an oil-bearing zone 206 near the top of a nearby subsurface geological structure 208. A second deviated well bore 210 branches off of vertical section 200 in a different radial direction to traverse a substantially horizontal sandstone reservoir 212 confined between impermeable shale beds 214 and 216.

Recently, Tesco Corporation of Calgary, Alberta, Canada, has developed a new method of deviated drilling referred to as casing drilling. In the casing drilling method, the bit is attached to the end of the casing, which is rotated from the surface. The bit can be detached and retrieved via a wireline for replacement while leaving the casing in place to support the walls of the well bore. Casing drilling facilitates penetration and retention of an intact bore through subsurface formations that are otherwise difficult to support. To date, casing drilling has economically produced more than two million feet of hole for oil and gas exploration and production.

Groundwater is generally produced from much shallower depths than hydrocarbons. The shallow water wells are generally much less expensive to drill than hydrocarbon wells, and groundwater production typically uses vertical wells. Such is the case in Hawaii. However, in situations where a fresh water lens overlies salt water within the coastal Hawaiian basal aquifer, vertical water wells may penetrate too deeply into the freshwater lens, eventually leading to upward coning and production of the underlying salt waters. When produced salt concentrations exceed drinking water or irrigation water standards, the well and, perhaps, the aquifer have to be abandoned.

It has long been recognized that a horizontal well or tunnel emplaced a small distance below the water table can skim the fresh water from a large area of such a shallow coastal aquifer, significantly prolonging the useful lifetime of the well by delaying the time when salt water contamination would end further production. However, because deviated drilling is considerably more costly than vertical well drilling, until now the method has been used rarely for water wells and nowhere for water wells in Hawaii. Deviated drilling techniques developed for petroleum exploitation have been applied for water production in some settings, such as in sedimentary rocks of the Persian Gulf, the Ogallala aquifer underlying a large part of the high plains of the United States, and the Austin Chalk formation in Texas. Since the early 1980s, Puna Geothermal Ventures and its predecessor in Puna, Hi., have used deviated wells for production of steam for geothermal use from formations 5,000 to 7,000 feet below sea level. These straight inclined steam wells were drilled from plugged vertical wells using wedges, and they deviate only about 20 to 30 degrees from vertical.

There are three different hydrogeological settings in Hawaii in which straight, substantially horizontal bores have been used to produce groundwater. The basal aquifer, a lens of freshwater floating at near sea-level upon saline water connected to the sea, has been tapped via wells on the islands of Maui (the "Maui wells") and Oahu that were drilled or driven horizontally from near the bottom of vertical or steeply inclined shafts. These shafts were hand-excavated to positions below the water table, and the horizontal extensions from the shafts have been hand-dug or drilled. Some of the Maui wells have been copious producers for nearly 100 years.

At higher elevations, typically in elevated central parts of each Hawaiian volcano, compartmented aquifers are contained within systems of vertical basalt dikes which act as groundwater dams. Also at higher elevations are perched aquifers, occurring where a buried clay soil or impermeable ash bed forms an aquiclude. Percolating rain water provides the water supply for the compartmented and perched aquifers. In the case of the perched aquifers, inclined strata or ancient soil layers with low water permeability deflect some of the vertically percolating rain water on its way down to the basal aquifer, and the perched water may emerge at the surface as springs. Unsaturated ground occurs between the aquiclude and the next underlying water table, often the lowest or "basal" aquifer. In some cases, vertical wells have inadvertently pierced aquicludes below perched water bodies, causing water to leak across the aquicludes and decreasing the amount of water flowing in the perched aquifer.

In Oahu, west Maui, Molokai, and Hawaii, both the compartmented aquifers and the perched aquifers can feed springs where the water spills into incised valleys. The early ranchers and planters recognized the nature of the spring water sources, and in some of the deeply-incised valleys of Oahu and west Maui, they were able to drive sub-horizontal tunnels to intersect one or more dikes at levels below the water table, facilitating drawdown and the use of the reservoir capacity to sustain flow in irrigation ditches feeding the cane-fields. To tap perched aquifers, their strategy was to search for places where soils mantled ancient buried valley bottoms, with a trough in the soil layer channeling the perched waters towards the outcrop. FIG. 3 illustrates the approach followed by the ranchers. Topographic contours are indicated with solid lines 302, and the contours of a buried impermeable soil layer 304 are indicated with dashed lines. The ranchers would dig a tunnel 306 into the mountain near and above a spring 308 until the soil layer 304 was encountered at point A and then turned the tunnel parallel to the contour of the soil layer, following it into the thalweg of the ancient valley, where saturated ground lay deepest, to find a perched aquifer 310. These early Hawaiian horizontal tunnels or well bores were driven by hand mining or rotary drilling directly from nearby, steeply sloping canyon walls or from large-diameter vertical shafts. Some of these older horizontal bores are also copious producers.

In recent decades, the high cost of mining has precluded additional tunnel construction for water production from either the basal, compartmented, or perched aquifers. A scarcity of practical drilling sites and difficulties of access due to the steep terrain have left only the basal aquifers as good candidates for increasing water supplies. Meanwhile, rotary drilling technology has flourished, so essentially all new water sources have been developed by drilling vertical wells to the basal aquifer. Even in steep terrain, vertical wells have been more practical to drill than horizontal wells, because gravity aids in the vertical drilling process, while horizontal wells require special drilling technology and equipment and are, therefore, more expensive. Further, the rock formations in Hawaii are notoriously difficult to drill using rotary drill bits, such as are generally used to drill horizontal wells. No new horizontal bores of this type have been excavated in nearly 100 years, due to both the high cost of hand tunneling and to a lack of favorable sites. Thus, there is a need for a method of drilling into compartmented and perched aquifers.

Some Hawaiian basal aquifers are currently in danger of eventual abandonment due to gradually increasing salinities of waters produced through the vertical wells. For many of the municipal and irrigation wells that require large discharges, the depth of penetration into the fresh water lens has been excessive. Heavy withdrawals and drawdown have caused brackish water to enter the bottom portion of such wells, as the saline water below the lens up-cones towards the well. It is uneconomic to replace the wells of excessive depth by more numerous, shallow wells. Vertical wells provide only temporary sources of freshwater supply where drilled to the basal aquifers.

Further, when sea level rises as an inevitable consequence of global warming, the basal aquifer will rise with it. Vertical wells penetrating deeply into the fresh water lens will become contaminated sooner as the underlying salt water rises. On Maui in 2000, the water table stood 6 to 12 feet above sea level at the eleven wells producing from the Tao aquifer, so the fresh water lens may be 240 to 480 feet thick. But the average elevation of the bottom of those wells is 206 feet below sea level. Many wells tap lava tubes or bottom fairly close to the transition zone, a fact manifested by gradually increasing salinity, especially when they are produced heavily. In the worst case scenario, sea level may rise as much as 40 feet in this century, so it is likely that many more wells will have to be abandoned because their salinity exceeds potable water criteria. At the same time, groundwater supplies may be increased by heavier, more cyclonic precipitation on the islands.

Thus, there is a need for a method for producing water in volcanic terrain that is less prone to coning of salt water. There also is a need for a method for producing water from rock formations that are difficult to drill using conventional rotary drill bits. There is an additional need for a method for drilling wells originating from a vertical section of well to provide easier access to aquifers that occur as lenses above salt water or that are compartmented or perched. There is yet another need for a method of drilling wells into aquifers in a manner that maximizes water production and/or prolongs the useful lifetime of the well and the aquifer.

SUMMARY OF THE INVENTION

In accordance with the purpose of the present invention broadly described herein, one embodiment of this invention comprises a method for constructing a water well into a subterranean aquifer below a water table. The method comprises the steps of drilling a first section of a well in a direction from the earth's surface, the direction selected from downward, laterally, and combinations thereof; causing the drilling direction to deviate from said direction of said first section in a predetermined path to intersect the aquifer; and continuing to drill in a path extending into the aquifer at a predetermined depth below the water table. The aquifer is a fresh water aquifer positioned within a subsurface formation of the type found in Hawaii, including volcanic formations, hard lava beds, fragmented interbeds that are prone to caving, and combinations thereof. The subsurface formation may be selected from basalt lavas, clinker interbeds, pyroclastic ashes, tuffs, palagonites, agglomerates, volcanic conglomerates, sedimentary alluvium, coral, soils, and combinations thereof. Preferably, the formation is in Hawaii.

The aquifer may be a basal aquifer directly underlain by salt water and occurring within and across strata, with the strata having a non-zero dip and a strike. In this case, the path extends into the aquifer substantially horizontally and is oriented in a direction selected from substantially parallel to the strike of the strata and substantially parallel to contours of the water table. The aquifer may be a basal aquifer directly underlain by salt water and occurring within rocks comprising basalt lava, pyroclastics, coral, sediments, or combinations thereof. Alternatively, the aquifer may be a basal aquifer directly underlain by salt water, and in this case, the continuing step comprises drilling in a substantially horizontal path near the top of the aquifer. Also alternatively, the aquifer may be a dike-compartmented aquifer either within the basal aquifer or at a higher elevation inland from the coast. In such a dike-compartmented aquifer, the strata within a compartment may have a strike direction, and the well may have a productive section oriented at a substantial angle from the strike direction of strata. Alternatively, the subsurface formation may include a confined fresh water aquifer at a level below a basal aquifer.

In the method, any of the drilling, causing, and continuing steps may comprise combining a steerable drilling tool, a drill bit, and a casing for advance or rotation. The drill bit may be a percussion drill bit or a rotary drill bit. Any of the drilling, causing, and continuing steps may further comprise using a down-hole driving device selected from down-hole motors and hammers, and possibly also a drill stem or casing for advance or rotation of the drill bit. Alternatively, any of the drilling, causing, and continuing steps may further comprise using a rotary drill bit, a down-hole motor, and casing for advance or rotation of said drill bit.

If the aquifer is a basal aquifer directly underlain by salt water and occurring within rocks comprising basalt lava, pyroclastics, coral, sediments, or combinations thereof, the method may further comprise the step of enhancing the stability of drill hole walls by a method selected from hammer compaction, injection of cementitious materials and combinations thereof, wherein said enhancing step occurs at a time selected from prior to and after drilling in any of the drilling, causing and continuing steps. Also, the method may further comprise the step of using the well for a purpose selected from water production, subsurface exploration, and pressure control.

It may be desirable to repeat the causing and continuing steps to drill a plurality of sections extending into the aquifer in different directions substantially along the strike direction. Also, it may be desirable to repeat the causing and continuing steps to drill a plurality of sections, each section extending into a different volcanic bed of the same aquifer.

BRIEF DESCRIPTION OF THE DRAWINGS

These and other features, aspects, and advantages of the present invention will become better understood with reference to the following description, appended claims, and accompanying drawings, where:

DETAILED DESCRIPTION OF THE INVENTION

Figure 1:
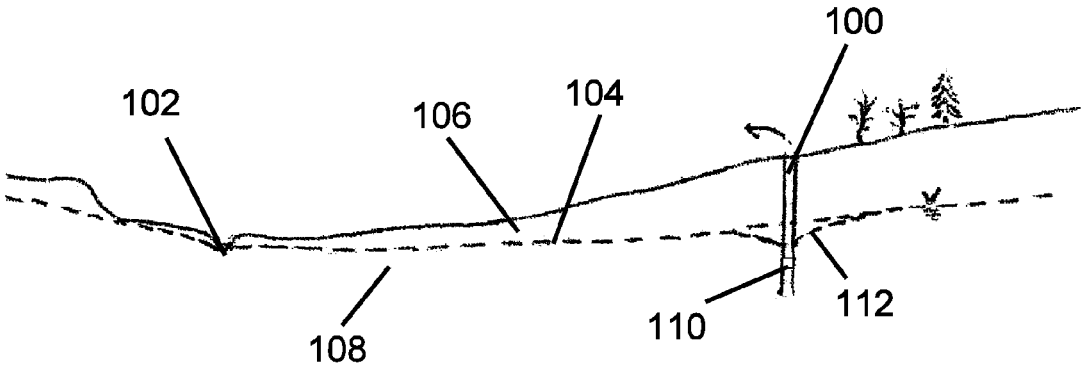
Fig. 1 (prior art)
FIG. 1 is a vertical section through the ground showing common water table conditions, drained to a nearby stream, and a well for prior art water production.
Figure 2:
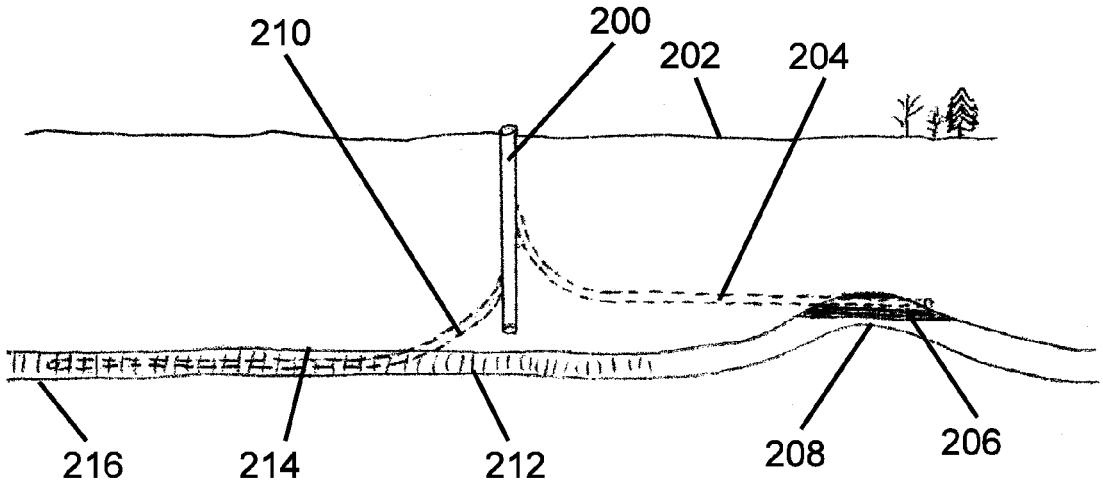
Fig. 2 (prior art)
FIG. 2 is a vertical section through the ground showing circumstances where prior art horizontal deviated drilling has been used for oil and gas production.

Maintaining potable water supplies for a burgeoning population is widely recognized as a problem, especially on islands in the sea that are hydrologically limited. Some of the vertical wells currently utilized in Hawaii for producing large yields for municipal and agricultural needs are becoming progressively contaminated, which necessitates abandonment of individual wells and ultimately, whole parts of the coastal aquifers, which are irreplaceable sources of fresh water. The reason for their failure is that generous producers have to be drilled too deeply into the fresh-water lens, and they produce from limited areas of the aquifers. These long-standing problems of water supply, leading to critical shortages of potable water, are developing and will become increasingly critical as the population increases.

The present invention provides a solution to this problem specific to the volcanic aquifers of the Hawaiian Islands and other coastal extrusive rocks. It comprises drilling deviated holes to access the several aquifer types present in Hawaii and perhaps elsewhere. This invention comprises a combination of techniques of deviated drilling, casing drilling, use of percussion and rotary drill bits, and, optionally, an additional step of pre-grouting a portion of the formation by injection of cementitious materials before drilling. These techniques were developed for the oil business and practiced in different types of formations on the continents, wherein wells are started vertically at the surface, then are curved or deviated at depth to assume sub-horizontal attitudes in productive formations. For wells on volcanic islands, such as the Hawaiian islands, production of water from deviated segments below the water table provides uniquely practical solutions to existing problems of minimizing salt-water contamination while maximizing yields from thin basal lenses of fresh water floating on salt water.

The deviated holes of this invention, as applied to basal, coastal aquifers, not only produce from more distributed areas and shallower depths than the vertical wells, but they also solve problems of access to high-level aquifers under central parts of the volcanoes. Whereas some deeply-incised valleys providing direct access for horizontal wells are present in interior parts of Maui, Oahu, and Kauai, deviated holes provide access to those high-level aquifers, previously largely undeveloped, beneath the slopes of younger volcanoes not yet eroded by streams, as occur on the Big Island of Hawaii, Maui, Molokai and elsewhere. The types of Hawaiian aquifers to which the present invention applies are described in more detail below. The drilling methods which may be used to construct deviated holes include rotary and percussion, with tools carried on drill-stem or casing, either of which may provide rotation. In particular, it is desirable to combine casing drilling with percussion bits to drive deviated holes.

The Hawaiian Islands are volcanic in origin, and throughout the islands, stratified lava flows slope towards the sea. In basaltic volcanic areas, such as Hawaii, lava flows dip toward the sea at a relatively shallow angle, often about 10 to 13 degrees. The lava flows are hard but fractured rocks, interbedded with palagonates, conglomerates, sedimentary alluvium, and pyroclastic granular strata, including tuff (ash), clinker, breccia, and agglomerate, most of which contain and transmit much more water than do the lavas. Near the coastline, coral may also occur in interbeds. In addition to water flow along interbeds between lavas, a smaller flow component is approximately normal to the lava beds via fractures in the beds. Although abundant rain, about 300 to 400 inches per year, falls on the mountains, there is little runoff, because most of the precipitation percolates through an extensive unsaturated zone to the water table not far above sea level, recharging what is called the "basal" aquifer.

The basal aquifer in Hawaii is vital to the island economy, serving most of the needs of agriculture and domestic consumption through pumped wells, some of which yield over a million gallons per day. Even though the volcano summits are thousands of feet above sea level, most of the demand for water is near the coast at altitudes of a few hundred feet or less. Thus, most water wells in the islands, including nearly all of the municipal wells, are also located near the coast.

Figure 4:
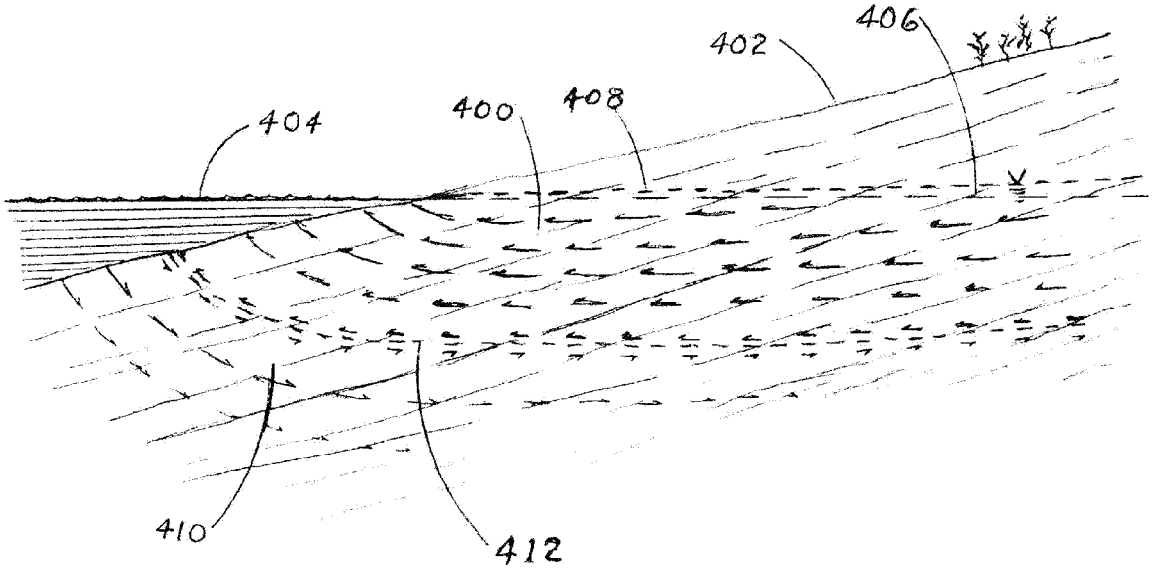
FIG. 4 is a vertical section through the ground along an azimuth normal to the sea shore and normal to the strike of bedding, showing typical water table conditions of a basal aquifer beneath Hawaiian volcanic terrains.

In very permeable rocks and soils such as those typical of Hawaii, the water table of the basal aquifer is nearly flat, sloping gently less than one degree towards the groundwater discharge areas. FIG. 4 illustrates the nature of the basal aquifer 400. The ground surface 402 slopes gently toward the sea 404, and the long dashed line 406 indicates sea level. The basal fresh-water aquifer 400 has water table 408, and it has limited volume in this coastal environment because it is underlain by saline water 410. The higher density of salt water (about 2% greater at 19,600 mg/l of NaCl in solution) compared to fresh water has, over eons of time, caused the salt water to invade the volcanic rock formations, so that it underlies the fresh water floating upon it, as shown in FIG. 4. Rather than a sharp interface between fresh and salt water, the short dashed lines 412 approximate a zone of salinity transition, grading from fresh above, to brackish, then to saline with depth. Small hydraulic gradients of the water table slope are sufficient to drive to the sea the large volume of fresh water that recharges the groundwater. The hydraulic gradient causes both the fresh and mixed waters to flow seaward, partially compensated by a landward movement of salt water to replace the salt, depicted by the arrows in FIG. 4.

The level at which half seawater composition is found can be predicted by the Ghyben-Herzberg relationship, which balances a static salt-water column against a taller but lighter fresh-water column. This indicates that the theoretical 9,800 mg/l isochlor (line of equal chlorine content) is to be found at about 40 feet below sea level for each foot that the water table lies above sea level. Thus if a well is drilled 300 feet to the water table, penetrating it say 10 feet above sea level, water with less than 9,800 mg/l salt may extend about 400 feet below sea level. But in these pervious volcanic rocks, the transition zone is typically many feet thick, thus the useable fresh water (<250 mg/l salt) occupies a body shaped like a part of a lens, in most places little more than 100 feet thick, underlain by salty water. Wells cannot safely penetrate the full thickness of the lens of useful quality water without risking upward coning of brackish water whose production contaminates the fresh water in the well bore.

Not shown in FIG. 4 is the typical profile of valleys eroded into the flanks of the volcanoes, providing access to drill sites closer to the water table. Most municipal wells in Hawaii take advantage of valleys to gain proximity to the water table. Near the coasts, where nearly all the people live and where agriculture abounds, the water table of the basal aquifer is only a few feet or tens of feet above sea level. Consequently, typical well depths of 200-300 feet are required to reach the fresh water, and nearly all drilling has been for vertical wells. A horizontal well, even if drilled from within a canyon and able to drain via gravity, would be significantly longer and thus more costly to drill.

Figure 5:
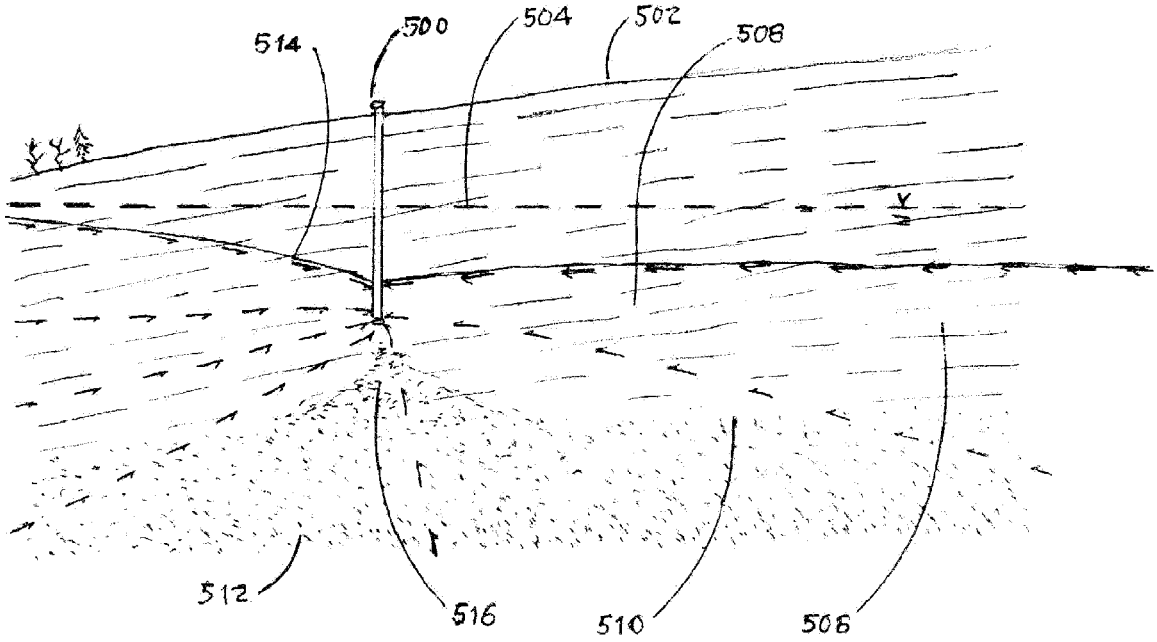
Fig. 5 (prior art)
FIG. 5 is a vertical section through the ground along an azimuth normal to the strike of bedding, showing asymmetrical flow into a prior art vertical well.

One embodiment of the method of the present invention, with deviated wells sunk to basal, salt-supported aquifers, is intended to mitigate the salt water contamination that may occur to vertical wells sunk deeper into the basal aquifer. When a vertical well is pumped for some time, it perturbs the natural gradients to induce flow towards the well, as illustrated in FIG. 5. Vertical well 500 extends from the ground surface 502 past water table 504 into basal aquifer 506. Below the fresh water zone 508 of the aquifer lie brackish water 510 and saline water 512. Adjacent to well 500, downward flow of fresh water from above the producing section of the well causes the water table to have a cone-shaped depression 514 around the well, and upward flow of salty water from beneath the well causes formation of an upwardly pointing cone 516 of saline water around the bottom of the well 500. The longer pumping persists, the greater the yield of salt to the well, and the average water salinity, after mixing in the well bore and pipelines, gradually increases. When the salt concentration of the mixed water reaches about 250 mg/l NaCl, it is no longer deemed potable, whereupon the well, and, ultimately, a portion of the aquifer may have to be abandoned.

As used herein, the term "strike" refers to the azimuth of the intersection of an inclined bed with a horizontal plane, and the terms "dip" and "dipping" refer to a direction normal to the strike of the bed.

Figure 6:
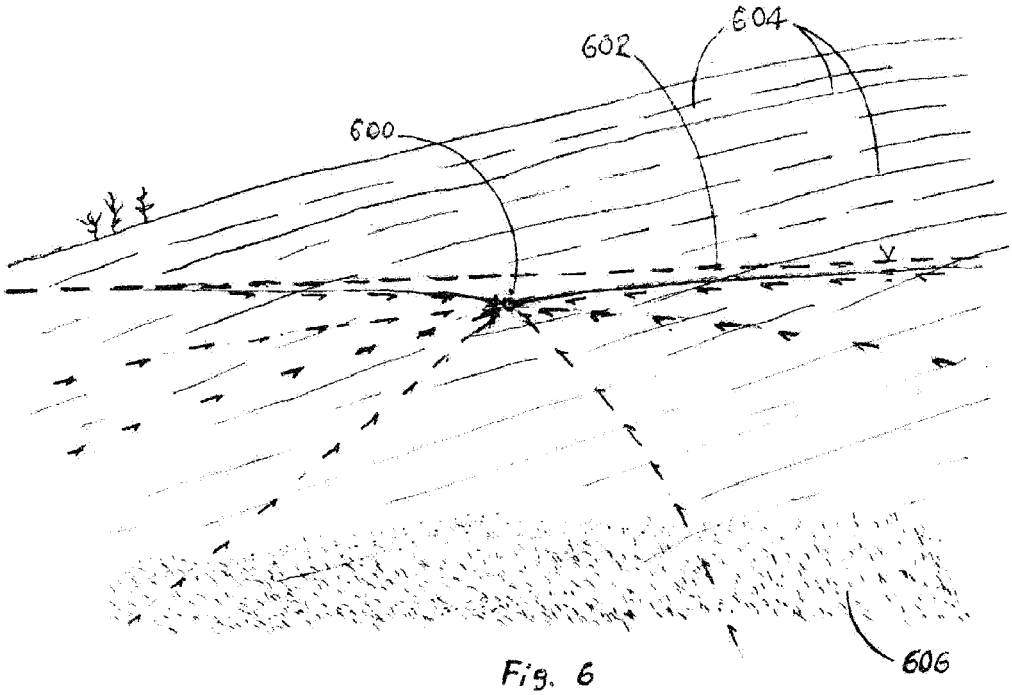
FIG. 6 is a vertical section through the ground along an azimuth normal to the strike of bedding showing channels of equal discharge into a section of a horizontal well having asymmetric flow and placed along the strike of bedding in accordance with the method of the present invention.

In accordance with the present invention, a deviated or horizontal water well can be drilled into an aquifer containing a fresh water lens floating on salt water, such as can be found beneath the coastal reaches of the Hawaiian Islands or any other coastal aquifer connected to the sea. Many advantages would be derived from a horizontal or near-horizontal well or system of horizontal or near-horizontal wells to produce groundwater from the freshwater lens that floats upon salt waters. Referring to FIG. 6, a horizontal well 600 can be practically situated a few feet below the original water table 602 to create a different, more sustainable and thus more beneficial groundwater flow pattern than does a vertical well. Well 600, viewed in cross section as a circle, extends substantially horizontally in and out of the page, substantially parallel to the strike of lava beds 604. With its horizontal orientation near the top of the aquifer, well 600 is much slower to yield contaminated water than the typical vertical production well that extends more deeply into the aquifer. Because horizontal wells such as well 600 skim fresh water from near the water table 602, the upward coning of salt water 606 can be avoided. Thus, well 600 can facilitate continued production of potable quality water for several times as many years as will a vertical well. Wells such as well 600 can extend for many hundreds of feet along and just beneath the water table so as to yield large discharges.

In accordance with the present invention, it is recognized that the substantially horizontal segment of such deviated wells can be drilled nearly along strike of the dipping formations, as that direction would be on an azimuth or its reciprocal most favorable to remain at shallow depths below the original water table, yet produce water from the highly-conductive fragmental beds and intersected lava tubes which prevail with down-dip orientations.

Just how perfectly the horizontal well system performs depends not only upon its placement, but also on the formation properties, which are currently ill-defined, varying from place to place. With some measures of apparent hydraulic conductivities, K, based on vertical well production versus drawdown data, some cultured guesses can be made about the future behavior of horizontal wells. The formation is doubtless very anisotropic, with greatest hydraulic conductivity (K) values parallel to bedding, least normal to bedding. Since the current vertical wells are nearly normal to the lavas, the apparent K is roughly the geometric mean of K in the downdip (slope) direction and K along strike (contour). Probably the former exceeds the latter, since some stream channels formed between eruptions, leaving buried agglomerate-filled conduits, and many open lava tubes formed along that same up-and-down-slope direction.

Conductivity normal to the lavas is uncertain but finite because flow occurs parallel to the water table, cutting the bedding at an acute angle, as seen in FIG. 4. All three principle conductivities would need to be measured to facilitate design and to predict accurately the performance of horizontal wells. To maximize yields, the best orientation for a horizontal well is along the strike of the lava beds, since it would have apparent conductivity that is approximately the geometric mean of K downdip and K normal.

Suppose, for example, that $K_d=7\ K_s=49\ K_n$, where the subscripts d, s and n represent the downdip, strike and normal directions, respectively. In that hypothetical case, a horizontal well following the strike direction would manifest the apparent $K=(K_n\ K_d)^{1/2}=7\ K_n$, whereas a vertical well reflects an apparent $K=(K_sK_d)^{1/2}=18.5\ K_n$. Thus a 100-foot vertical well would yield 2.65 as much per unit length as does a strike well, or the same as a 265 foot long horizontal strike well. A horizontal strike well can produce more than a vertical well because it is unlimited in length.

Figure 7:
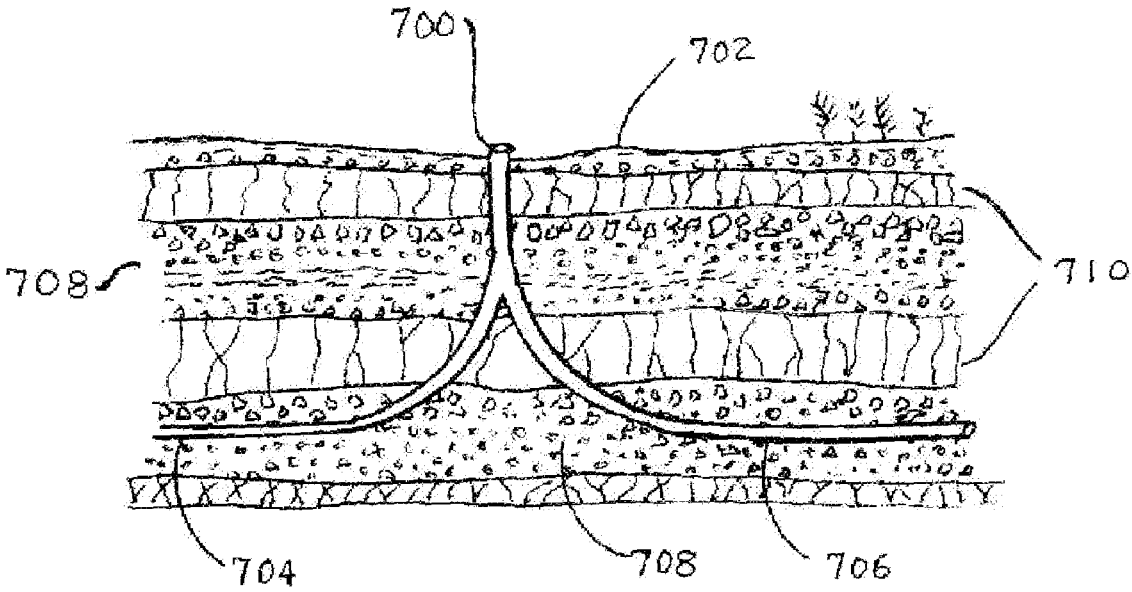
FIG. 7 is a vertical section through the ground along an azimuth parallel to the strike of bedding, showing a sequence of lavas and fragmental interbeds and a well placed in accordance with the methods of the present invention, initiated vertically at the surface and then deviated to subhorizontal attitude below the water table along an azimuth parallel to the strike of bedding.
Figure 8:
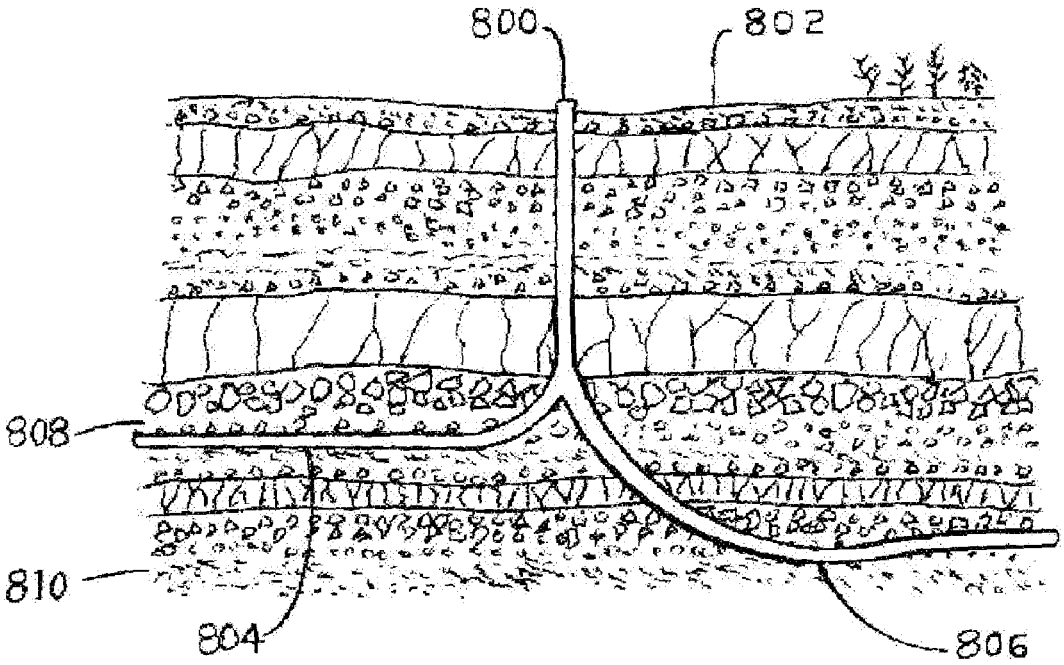
FIG. 8 is a vertical section through the ground along an azimuth parallel to the strike of bedding showing multiple horizontal bores deviated from a vertical well into different interbeds below the water table in accordance with the present invention.

Thus, it is desirable to drill horizontal wells that tap the basal aquifers approximately along the strike of the dipping lava beds, as shown in FIGS. 6-9, to greatly enhance the life of basal aquifers of fresh water floating on salt water. The wells can be initiated as substantially vertical wells descending from the surface and then deviated to horizontal or near-horizontal at a depth slightly below the water table. Using whipstocking methods known in the oil and gas industry, multiple horizontal bores can be drilled from a single vertical section. For example, as shown in FIG. 7, a vertical well 700 can descend from the surface 702, with two horizontal bores 704 and 706 extending approximately horizontally in opposite directions along the strike of the beds or within or nearly within a single interbed, 708 between lavas 710. Alternatively, as shown in FIG. 8, a single vertical well 800 could be drilled downward from the surface 802, and horizontal bores 804 and 806 could be placed in different interbeds 808 and 810, respectively. It should be noted that more than two horizontal or nearly horizontal sections could extend from a single vertical section of a well, and a horizontal section could be inclined approximately parallel to the water table but at other angles to the strike of the beds (not shown).

Although sea level is expected to rise during this century as a result of global warming, horizontal wells placed near sea level now will be buffered from salt water encroachment by nearly the full thickness of the fresh water lens, so the impact of rising sea level will be minimal for them. Although embedment will increase as sea level rises, generous separation from the underlying salt waters will continue to preserve the good water quality produced by horizontal wells. It would be prudent policy to commit public funding to new basal aquifer wells that are deviated to produce from shallow horizontal segments.

Compared to conventional production via vertical drilled wells, greater aquifer longevity is predicted if groundwater production is done through horizontal wells skimming the freshest water from the uppermost portion of a freshwater lens floating upon salt water in coastal environments such as the Hawaiian Islands. Not only is the distance between the well and the underlying zone of transition to brackish and saline waters greater in the case of horizontal wells compared to vertical wells, but the speed of movement is minimized by the comparatively low conductivity of the formations in the direction normal to the slightly-inclined bedded lavas and interbeds.

Because horizontal wells may be drilled many hundreds of feet, and occasionally a thousand feet or more at depths just a few feet below the original water table, their yields may exceed those of vertical wells limited by the thickness of the freshwater lens, leading to more efficient well field arrangements for aquifer management. Thus, horizontal drilling technology, similar to what has been used in the oil industry in the United States, the North Sea, the Middle East, North Africa and elsewhere, can be imported to the Hawaiian Islands and other coastal environments where salt water underlies thin basal fresh-water aquifers. A particularly applicable subset of the horizontal drilling technology is that of casing or liner drilling, which can help solve the prevalent problems of hole support and permanence commonly encountered in the Hawaiian basalt formations.

It may be desirable to pre-grout the subsurface formation to consolidate loose or broken rocks and reduce the risk of drilling difficulties or failures. In one procedure, a small-diameter pilot bore is drilled, and a cementitious material is injected through the pilot bore. Then a larger diameter bore is drilled concentric with the pilot bore.

A greater proportion of the infiltrating rainwater that recharges the Hawaiian basalt basal aquifers will be recoverable if horizontal wells are employed, rather than a greater number of vertical wells, and less water will be wasted to the sea. This will be commensurate with the greater longevity of such aquifers produced to horizontal wells instead of the current system of vertical wells. In areas already limited by the apparent need to conserve the fresh groundwater threatened by slowly-rising salinities observed in well-waters, horizontal wells can optimize resource development and utilization, making more potable water available for current and future use.

Besides the basal aquifer, found near sea level under all Hawaiian coasts and extending some miles inland, there are other occurrences of water in the subsurface, including high-level compartmented aquifers and perched aquifers. In some cases, these types of aquifers occur in topographic settings such as deeply-incised valleys, but such situations are rare on most islands, and the few opportunities for horizontal wells drilled directly from the valley walls have, for the most part, been already exploited. There are additional compartmented and perched aquifers that until now could not easily be drilled except via prohibitively long straight horizontal holes, making these wells uneconomic. However, additional supplies of fresh water may be developed from these aquifers using deviated drilling techniques in accordance with the present invention, and these fresh water supplies provide favorable targets for deviated drilling from the uneroded volcano surfaces.

Near the center of a volcano, steeply dipping to vertical dikes of basalt form during the volcano-building as molten lava rises through deep cracks in the interior of the volcano, fills the cracks, and then solidifies. Many dikes trend subparallel, concentrated around topographic ridges and aligned vents, defining what are called rift zones. Solidifying at depth and under high pressure in the mountain, the basalt dikes are generally massive and non-vesicular (i.e., free of gas bubbles), so they tend to have low permeability. However, fractures that form as the lava cools can act as minor conduits for water leakage across the dikes. The dikes generally act as impermeable underground dams to hold water, giving rise to elevated water bodies. The water table in each compartment depends upon the amount of recharge and the leakage through and under boundary dikes. If the water tables of adjacent compartments are different, water can leak from the compartment with the higher water table into the adjacent compartment with a lower water table, until the rate of recharge and the rate of leakage are balanced. Generally, the water tables step up to higher and higher levels as one approaches the summit or ridge of the volcano, and in some cases, the elevation differences in the water tables can be as great as thousands of feet. Electrical soundings have shown fresh water extending to great depths within such compartments. It is believed that salt water occurs at some depth below these compartmented aquifers, perhaps as deep as 40,000 feet. However, no one has drilled to confirm the limits of the fresh-water bodies, and they are probably far below any vertical drilling capabilities. Recent discovery of multiple fresh water aquifers at depths of many hundreds of feet below sea level suggests leakage of dike compartments into pervious confined strata, perhaps through or under the lower limits of dikes. Such aquifers may also be tapped with deviated holes seeking to remain in fresh water over considerable strike distances.

Figure 9:
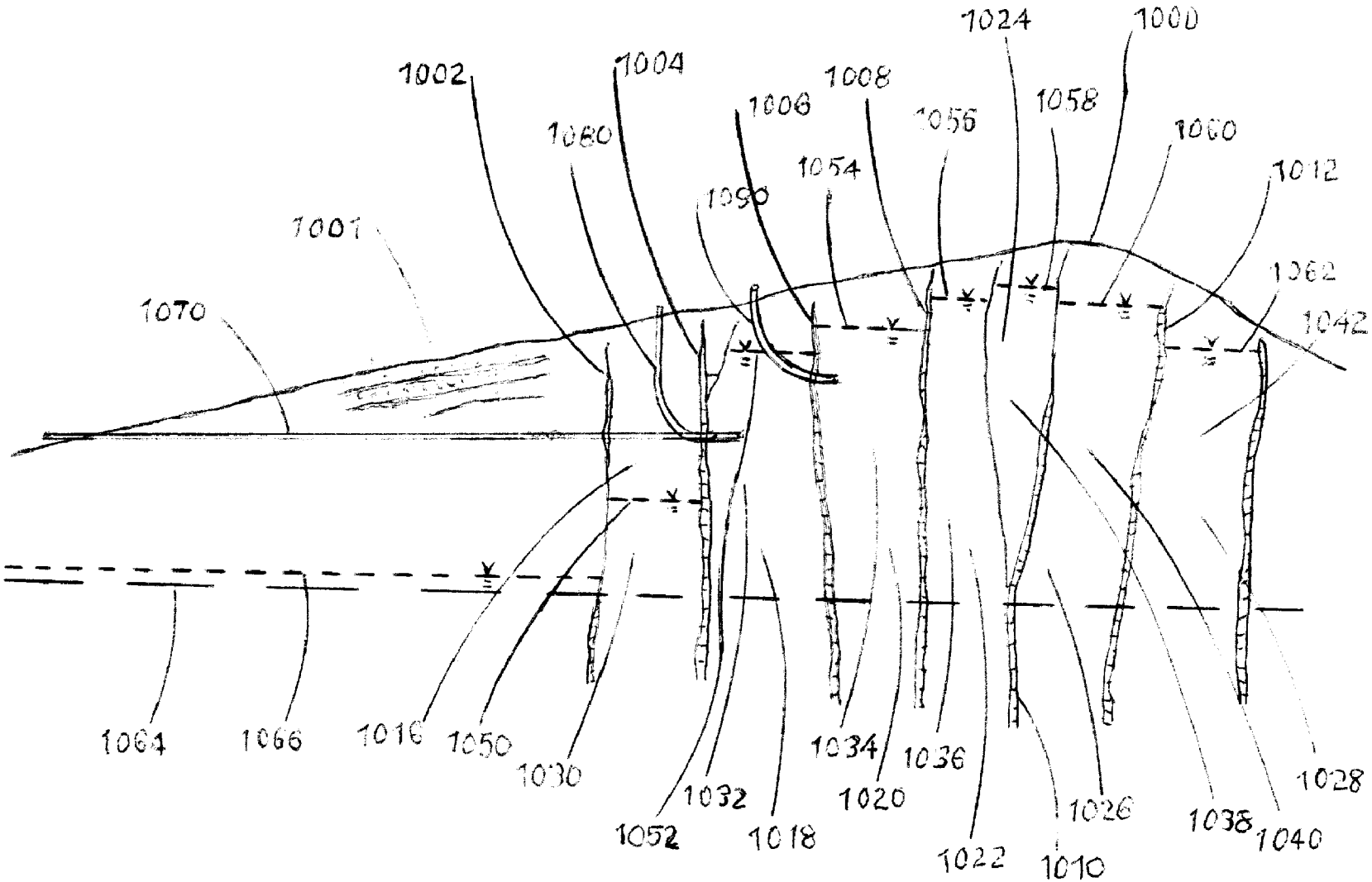
FIG. 9 is a vertical section through the ground across the summit of a volcano and normal to the strike of the rift of such a volcano showing several of the sub-vertical basalt dikes that have intruded the stratified lavas and interbeds, with the water table interrupted by such dikes and stair-stepping downwards towards the coast, with different levels in each compartment of the groundwater body, and with alternative configurations of wells, one long well horizontal from the surface to tap a compartment, and two wells deviated from vertical to horizontal into the compartments.

The nature of dike-compartmented groundwater bodies can be understood with reference to FIG. 9. Volcano 1000, composed everywhere of lavas and interbeds 1001, includes a number of approximately vertical and relatively water-impermeable dikes 1002, 1004, 1006, 1008, 1010, and 1012. Compartments 1016, 1018, 1020, 1022, 1024, 1026, and 1028 are formed between dikes 1002, 1004, 1006, 1008, 1010, and 1012, respectively. Each compartment partially encloses an aquifer 1030, 1032, 1034, 1036, 1038, 1040 or 1042. The aquifers have stepped water tables 1052, 1054, 1056, 1058, 1060, and 1062, all of which are significantly higher than sea level 1064 and the water table 1066 of the basal aquifer.

The water bodies contained within the dike systems, such as the system illustrated in FIG. 9, may discharge to springs and streams high on mountainsides. Until now, these water sources have been accessible at springs or via tunneling from deep valleys, such as those leading into the West Maui mountains and the other dissected older volcanoes on the islands of Oahu and Kauai. Generally, horizontal tunneling or drilling into the dike-compartmented water bodies from younger volcanoes, such as Haleakala or Mauna Kea, has been impractical or impossible, due to the long horizontal distances from portal sites to the water bodies. Horizontal conduit 1070 in FIG. 9 illustrates this problem.

As shown in FIG. 9, deviated wells in accordance with the present invention, such as wells 1080 and 1090, provide the decided advantage of shortening the distance from the surface to a point of dike penetration below a compartment's water table. Well 1080 originates at the surface above the dike-bounded compartment 1016, descends vertically through the unsaturated zone in compartment 1016 to a depth below water table 1052, and then changes direction to a horizontal or near-horizontal path and penetrates dike 1004 to access water in compartment 1018. The vertical section of well 1080 is significantly shorter than a horizontal conduit such as conduit 1070. Alternatively, a single well, such as well 1090, may collect water from multiple aquifers, such as aquifers 1032 and 1034. Well 1090 descends vertically through compartment 1018 to a depth below the water table 1052 in compartment 1018 and also below water table 1054 in compartment

1020. Well 1090 then deviates and passes through dike 1006 to collect water from both aquifers.

The method of the present invention provides many more opportunities to tap compartmented water bodies since wells that start vertically, reach the desired level, and then deviate to a shallow or horizontal attitude can be used wherever high-level water table conditions and the dikes that support them can be found. Although dikes often do not surface through recent lava flows on undissected slopes of young volcanoes, geophysical sounding methods can determine the presence of the dikes and the water levels between them.

Production from deviated compartment wells may require pumping if the collar elevation is above the water table or the compartment tapped. To facilitate use of a submersible pump, it may be desirable to design the well with a nearly horizontal section that slopes upward away from the vertical section of the well, creating a trap that remains filled with water. The water production from a well deviated into a compartment may require pumping if the collar elevation is above the water table of the compartment. The water may be used locally near the production site, or it may delivered to a high-level distribution system such as municipal water works. Such high-level supplies are more valuable than basal aquifer supplies due to savings in electrical energy.

Figure 3:
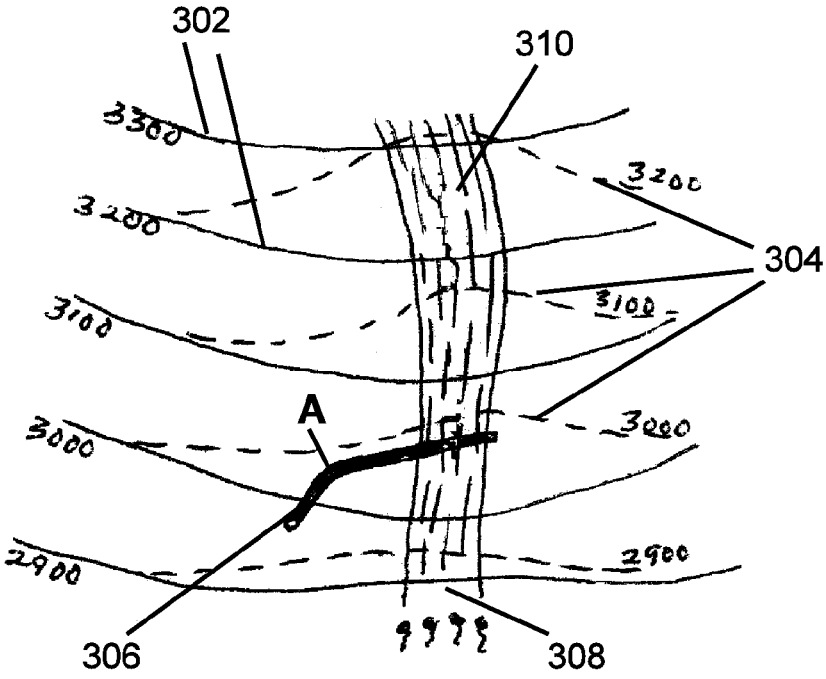
Fig. 3 (prior art)
FIG. 3 is a plan view of a prior art hand-excavated tunnel for water production driven subhorizontally from the surface into a perched aquifer on an impervious stratum, commonly a soil layer formed in an ancient valley buried by subsequent channel gravels, lavas and interbeds, as often occurs within a Hawaiian volcanic sequence.
Figure 10A:
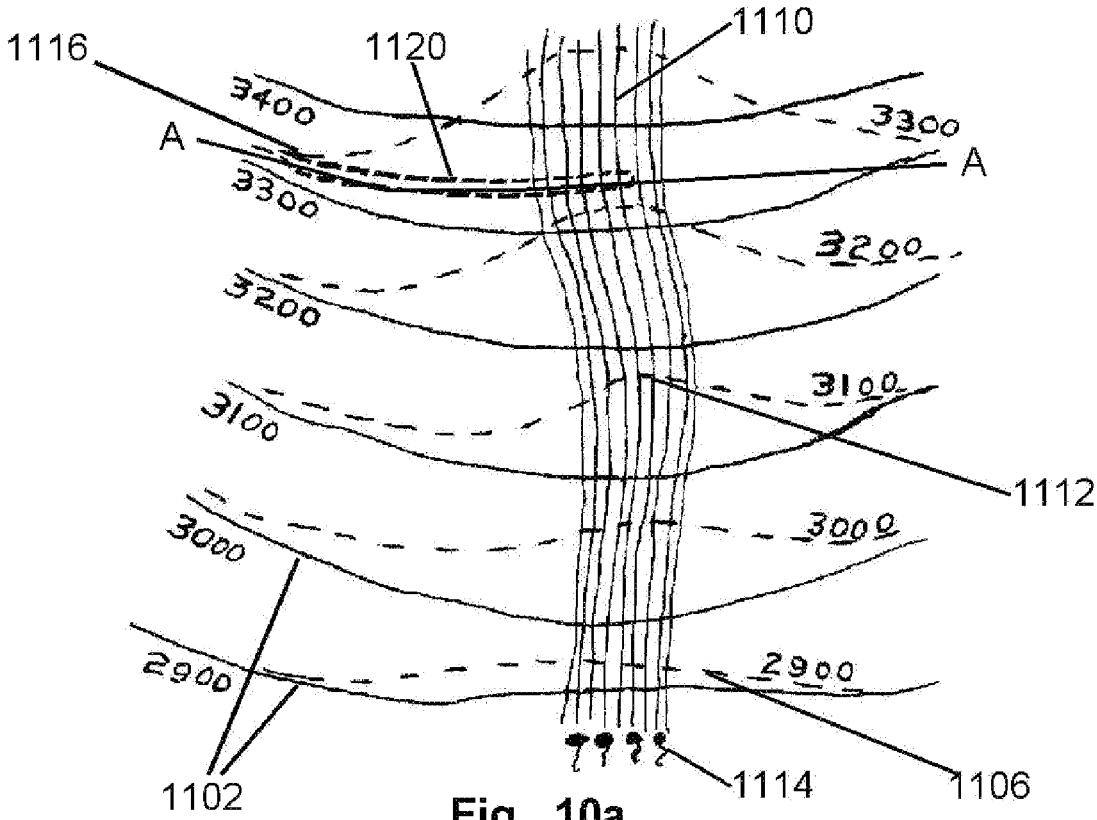
FIG. 10*a* is a plan view of a perched aquifer, such as is shown in FIG. 3, with solid contours depicting the ground surface, dashed lines depicting the top of the impervious perching stratum, the indicated surface location of a well drilled in accordance with the present invention, and the indicated deviated horizontal extension of such well following the top of the impervious stratum into the buried thalweg of the ancient valley where perched groundwater is channeled.
Figure 10B:
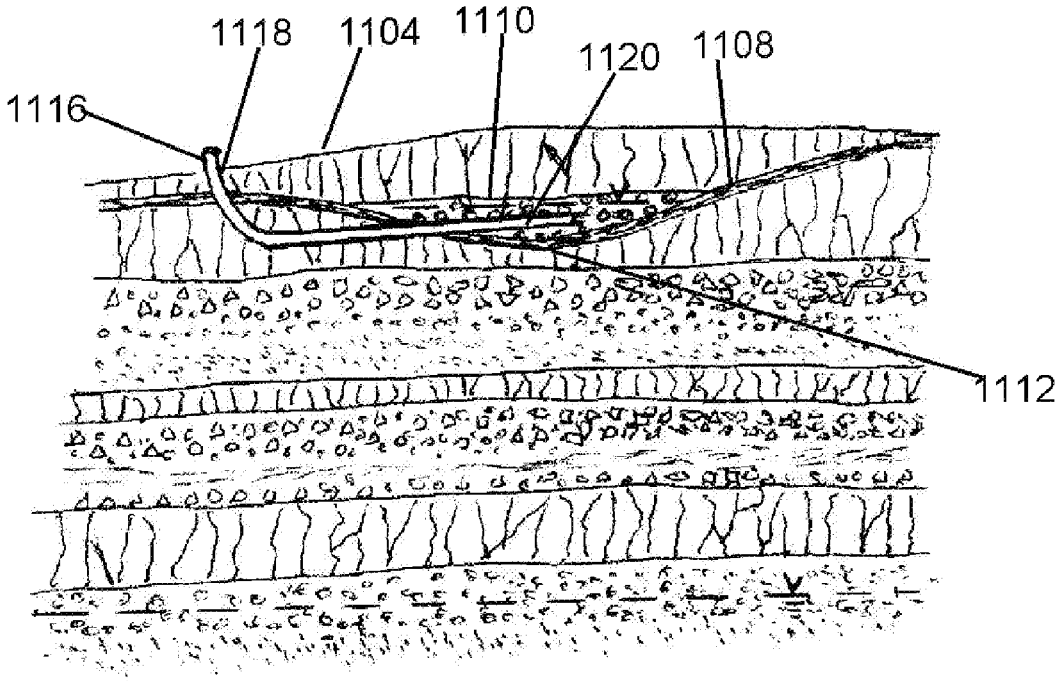
FIG. 10*b* is a vertical section through the ground along plane A-A approximately normal to the strike of bedding and normal to the horizontal section of the well of FIG. 10*a*, showing its position at the top of the impervious perching stratum.

Another type of aquifer found in many places, including Hawaii, is a perched aquifer. Perched aquifers occur when infiltrating ground water collects above a buried aquiclude, or impermeable layer, such as an ancient soil horizon, a layer of clay, or a bed of consolidated volcanic ash. FIGS. 10*a*-*b* illustrate a perched aquifer similar to that shown in FIG. 3. Solid lines 1102 in FIG. 10*a* indicate contours of surface 1104 (shown in FIG. 10*b*), and dashed lines 1106 in FIG. 10*a* indicate contours on a buried soil layer 1108 (shown in FIG. 10*b*). The contour lines 1102 and 1106 are associated with numbers indicating the contour elevations, between 2900 and 3400 feet above sea level. Aquifer 1110 is formed by precipitation percolating downward from the surface 1104 and collecting in the subsurface depression or thalweg 1112 formed by the soil layer 1108. Aquifer 1110 intersects the surface 1104 to form spring 1114 (shown in FIG. 10*a* and not in the plane of FIG. 10*b*). Well 1116 originates at the surface 1104 (FIG. 10*b*) at an elevation somewhat higher than spring 1114 and has a vertical section 1118 (FIG. 10*b*) descending from the surface 1104, thence deviated through a vertical arc to a substantially horizontal section 1120 (FIG. 10*b*) tangent to and following along contours of buried soil or other impervious layer 1108 into the perched aquifer 1110 until arriving at thalweg 1112. It may be possible to tap perched water bodies identified by the presence of a spring or by other means, such as geophysical surveying. By diverting the ground water flow into a well, such as well 1116, it may be possible by pumping to produce the full capacity of a perched aquifer, such as aquifer 1110, into a pipeline. In this case, any springs fed by the aquifer, such as spring 1114, would be dried up. Alternatively, deviated drilling may mimic the previously used water-tunneling technique to form a free-draining well (not shown) by initiating the hole at the surface at a lower elevation than the intended aquifer penetration point, drilling substantially horizontal or slightly inclined upwards, thence deviated through a horizontal arc to tangency with the soil layer and continuing into aquifer 1110.

Both of these types of high-altitude aquifers, dike compartmented groundwater bodies and perched water bodies, may prove to be the most common future applications of deviated drilling in Hawaii. Production via horizontal or deviated wells may provide a steady flow of a few gallons per minute (gpm), sufficient to provide water for residential subdivisions, in locations where vertical wells cannot be drilled. Such deviated or horizontal wells may be more economical than pipeline deliveries from scarce municipal supplies.

At low elevations, where only the basal aquifer offers prospects for subdivision water supplies, large capacity vertical wells that are deviated to horizontal and extend approximately parallel to the water table may provide discharges of 1000 gallons per minute (gpm) or more, sufficient to produce municipal water supplies. These less numerous wells may ultimately prove to be of great importance to the local population and government, because they will help maximize yields from the basal aquifer while preserving water quality and aquifer life.

In addition to providing water supplies, deviated and/or horizontal wells may have applications of a geotechnical nature. These applications include subsurface geological exploration and controlling water levels or water pressure in any aquifer best accessed by horizontal wells.

Well drilling is difficult in Hawaii, because the basalt lavas and their interbedded clinker zones and pyroclastics of all grain sizes create caving conditions, where the boreholes collapse. Indeed, even some vertical wells have been abandoned during construction or stopped short of their intended depths due to caving. Horizontal holes are even more difficult to drill, because dislodged rocks fall into the bore. Any motion of a detached fragment during or after passage of the drill bit may bind against the drill string or casing string and interfere with rotation or advance of the string. Consequently, horizontal drilling, either direct or deviated, has rarely been attempted through the Hawaiian basalt sequences. Tunneling, used in the past to create horizontal bores, has a much greater cost per foot than drilling.

Recently, Tesco Corp. of Calgary, Alberta, developed casing drilling, where a drill bit, usually of the rotary type, is attached to the end of a casing string and rotated from the surface. The bit is detached and retrieved by wireline for replacement while leaving the casing in place to support the ground. To date, the method has been used to drill more than two million feet of hole, mainly for oil and gas exploration and production. Not only does the casing drilling method minimize trip time for replacing worn drill bits, but it also facilitates penetration and retention of an intact bore through ground that is otherwise difficult to support. Typically, a hole is started with a large size casing, such as 12⅞ inch diameter, so that progressively smaller telescoping sizes may be inserted to prolong the hole when and if casing becomes stuck or resists turning. Reaming is also conducted to enlarge casing in the hole to facilitate passage of additional casing.

Percussion drilling, with penetration rates of tens of feet per hour, is more efficient for cutting through the tough basalt lava flows than is rotary drilling that produces penetration rates of a few inches per hour. Steerable percussion drilling, using an air-driven down-hole hammer, has not previously been used for deviated and perhaps horizontal drilling through formations such as those found in Hawaii. The percussion drilling tool may be attached to a rotating casing drilling string in a manner similar to that used for attaching rotary drill bits to casing. Alternatively, a conventionally percussion-drilled pilot hole may be followed by a casing-drive reamer to set casing behind the hammer drill. Either method of advancement, rotary or percussion, may thus be adapted to the construction of horizontal wells in the Hawaiian basalt formations.

Also, hammer bits are believed to densify the walls of holes advanced through fragmental formations, such as volcanic clinker and agglomerate beds, thereby providing stability.

Thus, hammer drilling also provides the necessary rapid hole advance when hard lavas are intercepted.

Another notable adaptation that may prove valuable for water production is the "whipstocking" or deviation of several holes from the same vertical starter well, as is known in the oil and gas industry.

These techniques may be applied beneficially in water-well drilling through loose or fragmented rocks, such as prevail in Hawaiian volcanics. Casing drilling of deviated wells may by used to solve the problems of hole support inherent to such formations as occur in Hawaii, and especially for horizontal bores. Casing drilling can provide immediate support to the walls of a drill hole, thereby solving the long-standing problem of walls caving as is common with conventional rotary drilling methods. Further, the combination of down-hole percussion tools on a bent assembly carried and rotated by casing driven from the surface provides a unique solution to the emplacement of deviated wells in Hawaii.

In addition to increasing or prolonging water production from individual wells, horizontal or deviated drilling in accordance with the present invention may enhance the value of land in areas that can be serviced by horizontal wells.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to, falling within the scope of the invention.

What is claimed is:

1. A method for constructing a water well into a subterranean aquifer below a water table, comprising the steps of:

drilling a first section of a well in a direction from the earth's surface, the direction selected from vertically, laterally, and combinations thereof;

causing the drilling direction to deviate from said direction of said first section in a predetermined path to intersect the aquifer; and continuing to drill in a path extending into the aquifer at a predetermined depth or a predetermined inclination below the water table;

wherein any of said drilling, causing, and continuing steps comprises combining a steerable drilling tool, a drill bit, and a casing for advance or rotation; and wherein the aquifer is a fresh water aquifer positioned within a subsurface formation of the type found in Hawaii, said formation including rock types selected from the group consisting of volcanic formations, hard lava beds, fragmented interbeds that are prone to caving, and combinations thereof; and the aquifer is a basal aquifer directly underlain by salt water;

and said continuing step comprises drilling in a substantially horizontal path near the top of the aquifer.

2. The method of claim 1, wherein the aquifer occurs within and across strata, the strata having a non-zero dip and a strike, and said path extends into the aquifer substantially horizontally and is oriented in a direction selected from substantially parallel to the strike of the strata and substantially parallel to contours of the water table.

3. The method of claim 1, wherein:

the aquifer occurs within rocks comprising basalt lava, pyroclastics, coral, sediments, or combinations thereof; and the subsurface formation is selected from the group consisting of basalt lavas, clinker interbeds, pyroclastic ashes, tuffs, palagonites, agglomerates, volcanic conglomerates, sedimentary alluvium, coral, soils, and combinations thereof.

4. The method of claim 1, wherein a portion of the aquifer is dike-compartmented.

5. The method of claim 1, wherein the aquifer occurs within rocks comprising basalt lava, pyroclastics, coral, sediments, or combinations thereof, the method further comprising the step of:

enhancing the stability of drill hole walls by a method selected from hammer compaction, injection of cementitious materials and combinations thereof;

wherein said enhancing step occurs at a time selected from prior to and after drilling in any of said drilling, causing and continuing steps.

6. The method of claim 1, wherein the aquifer occurs within rocks comprising basalt lava, pyroclastics, coral, sediments, or combinations thereof, the method further comprising the step of using said well for a purpose selected from water production, subsurface exploration, and pressure control.

7. A method for constructing a water well into a subterranean aquifer below a water table, comprising the steps of:

drilling a first section of a well in a direction from the earth's surface, the direction selected from vertically, laterally, and combinations thereof;

causing the drilling direction to deviate from said direction of said first section in a predetermined path to intersect the aquifer; and continuing to drill in a path extending into the aquifer at a predetermined depth or a predetermined inclination below the water table;

wherein:

the aquifer is positioned within a subsurface formation of the type found in Hawaii, said formation including rock types selected from the group consisting of volcanic formations, hard lava beds, fragmented interbeds that are prone to caving, fragmented interbeds that are not prone to caving, and combinations thereof;

the aquifer is a fresh water aquifer selected from the group consisting of basal aquifers, perched aquifers, confined fresh water aquifers at levels below a basal aquifer, dike-compartmented reservoirs, and combinations thereof; and any of said drilling, causing, and continuing steps comprises using drilling equipment selected from the group consisting of steerable drilling tools, rotary drill bits, percussion drill bits, casing for advance or rotation, and combinations thereof.

8. The method of claim 7, wherein:

the aquifer is a nearly flat-lying basal aquifer directly underlain by salt water;

the aquifer occurs within and across strata, the strata having a non-zero dip and strike;

said continuing step comprises drilling in a path in the group consisting of substantially horizontal and parallel to contours of the water table, substantially parallel to contours of the dipping strata, and combinations thereof, with said path positioned below and near the top of the aquifer to maximize distance from the underlying salt water while facilitating some drawdown of the water table.

9. The method of claim 7, wherein:

at least a portion of the aquifer is dike-compartmented, with a different water table in each compartment;

each different water table occurs at an elevation substantially higher than the water table of a basal aquifer and more substantially higher than any salt water underlying the aquifer;

the dike-compartmented portion of the aquifer lies within and across the volcanic strata;

said drilling step comprises drilling in a direction to penetrate at least one compartmenting dike or stratum; and said continuing step comprises drilling at any depth below the water table in a direction ranging from substantially horizontal to steeply inclined, with an azimuth oriented substantially parallel to a strike of the strata and substantially normal to a strike of the at least one dike.

10. The method of claim 7, wherein:

the aquifer is a perched aquifer, separated from underlying unsaturated rock by a base comprising a low-permeability stratum or soil layer; and said continuing step comprises drilling in a path that penetrates the perched aquifer substantially horizontally at a depth below the water table and substantially close to the base of the aquifer, with an azimuth selected from the group consisting of substantially parallel to the contours of the underlying stratum and substantially parallel to the contours of the water table.

11. The method of claim 7, wherein:

the aquifer is a confined aquifer, with fresh water flowing in at least one pervious bed, with the bed separated from adjoining salt or fresh water by low-permeability confining beds or strata; and said continuing step comprises drilling in a path that is substantially parallel to the confining beds and within the aquifer.

12. The method of claim 7, wherein the aquifer is positioned within a subsurface formation of the types found in Hawaii, including rock types selected from the group consisting of basalt lavas, clinker interbeds, pyroclastic ashes, tuffs, palagonites, agglomerates, volcanic conglomerates, sedimentary alluvium, coral, soils, and combinations thereof.

13. The method of claim 7, wherein:

said well penetrates at least one zone of a rock type that is prone to caving;

said well has a wall; and said method further comprising the steps of enhancing the stability of the wall at a time selected from the group consisting of prior to drilling in any of said drilling, causing or continuing steps; after drilling in any of said drilling, causing or continuing steps; and combinations thereof.

14. The method of claim 13, wherein said enhancing step comprises a method selected from group consisting of hammer compaction, injection of cementitious materials, and combinations thereof.

15. The method of claim 7, wherein any of said drilling, causing and continuing steps further comprises using a downhole drilling device selected from the group consisting of downhole motors, hammers, and rotary bits.

16. The method of claim 7, wherein said causing and continuing steps are repeated to drill a plurality of sections, each section extending into a different volcanic bed of the same aquifer.

17. The method of claim 7, wherein said well has a purpose selected from the group consisting of water production, subsurface exploration, and pressure control.

18. The method of claim 7, wherein said causing and continuing steps are repeated to drill a plurality of sections extending into the aquifer in different directions.

19. The method of claim 7, wherein any of said drilling, causing, and continuing stops comprises drilling with a combination of a percussion bit and casing for advance of said bit.

* * * * *